US005785445A

United States Patent [19]

Podosek et al.

[11] Patent Number: 5,785,445

[45] **Date of Patent: *Jul. 28, 1998**

[54] RING BINDER COVER

[75] Inventors: Edward Podosek, Wilbraham; Vytautas Kazimeras Beleckis, East Longmeadow, both of Mass.

[73] Assignee: Avery Dennison Corporation, Pasadena, Calif.

[ * ] Notice: The term of this patent shall not extend beyond the expiration date of Pat. No. 5,620,207.

[21] Appl. No.: 698,275

[22] Filed: Aug. 12, 1996

Related U.S. Application Data

[63] Continuation of Ser. No. 377,536, Jan. 23, 1995, abandoned, which is a continuation of Ser. No. 140,625, Oct. 21, 1993, abandoned, which is a continuation of Ser. No. 66,630, May 24, 1993, abandoned, which is a continuation of Ser. No. 871,909, Apr. 21, 1992, abandoned.

[51] Int. Cl.[6] ..... B42C 7/00; B42F 13/00

[52] U.S. Cl. ..... 402/73; 402/502; 281/29

[58] Field of Search ..... 281/29; 402/73–77, 402/502; 412/3, 17

[56] References Cited

U.S. PATENT DOCUMENTS

| | | | |
|---|---|---|---|
| 2,486,330 | 10/1949 | Schade | 251/29 |
| 3,190,678 | 6/1965 | Peterson et al. | 281/29 |
| 3,195,924 | 7/1965 | Carter et al. | 281/29 |
| 3,228,709 | 1/1966 | Tooker | 281/29 |
| 3,318,618 | 5/1967 | Mullen et al. | 281/29 |
| 3,572,957 | 3/1971 | Strassberg | 281/29 X |
| 4,214,839 | 7/1980 | Sheehan et al. | 402/38 X |
| 4,583,877 | 4/1986 | Wilson . | |
| 4,600,346 | 7/1986 | Podosek | 412/3 |
| 4,856,817 | 8/1989 | Moor | 281/29 |
| 5,127,786 | 7/1992 | Cross | 412/3 |
| 5,222,825 | 6/1993 | Wyant . | |

FOREIGN PATENT DOCUMENTS

| | | | |
|---|---|---|---|
| 739638 | 11/1955 | United Kingdom | 281/29 |
| 1123779 | 8/1968 | United Kingdom . | |

*Primary Examiner*—Frances Han

*Attorney, Agent, or Firm*—Kriegsman & Kriegsman

[57] ABSTRACT

A ring binder cover (4) is composed of a pair of thermoplastic sheets (20, 22) superimposed in edge-to-edge relation with a stiffener insert panel (23) disposed therebetween. The insert panel bears two parallel grooves (25, 27) which divide the insert into a spine zone (30) and two cover zones (24, 26). The material of the insert lying at the bottom of the grooves forms a pair of webs (32, 34) which, combined with the adjacent portions of the cover sheets, form hinges between the spine and each cover. The peripheral edge portions (40) of the two thermoplastic sheets are sealed together and provide a sealed envelope for the stiffener insert which defines semi-rigid back and front cover panels of the binder, hingedly connected to a rigid spine.

7 Claims, 5 Drawing Sheets

RING BINDER COVER

This application is a continuation of application(s) Ser. No. 08/377,536 filed on Jan. 23, 1995 abandoned which is a continuation of U.S. Ser. No. 08/140,625, filed Oct. 21, 1993 now abandoned, which is a continuation of U.S. Ser. No. 08/066,630, filed May 24, 1993, now abandoned, which is a continuation of U.S. Ser. No. 07/871,909, filed Apr. 21, 1992, now abandoned.

FIELD OF THE INVENTION

This invention relates to ring binders intended to hold sheets of material.

BACKGROUND OF THE INVENTION

For many years it has been the practice in the manufacture of ring binders to fabricate the cover for such binders in a three-ply construction. Three rigid or semirigid, rectangular inserts or stiffener panels are heat-sealed between two superimposed sheets of thermoplastic material. Of the three stiffener panels generally used, two of them approximate in size, the back and front panels of the binder. The third panel is a narrower insert strip disposed between the two larger panels to form the back panel or spine of the binder. The inner and outer plastic sheets are fused together or heat-sealed around their peripheral edges. The sheets are also sealed transversely between the adjacent, transverse edges of the cover panel inserts and the back panel inserts. The transverse seals form the hinge areas of the binder. U.S. Pat. No. 3,195,924 is typical of this type of binder construction.

There are several significant disadvantages in a conventional heat-sealed binder cover, particularly along the hinge portions where the cover and the spine or backbone of the binder intersect. Along the hinge lines, the outer plastic sheets are fused or heat-sealed together and their composite thickness is substantially less than the total thickness of the two sheets before the heat-sealing operation. For example: where the two outer sheets of thermoplastic are each 0.015 inch vinyl, the composite thickness, when fused together, is only about 0.020 inch or about 30% less than the total of 0.030 inch where there has been no heat-sealing of the plastic sheets. This thickness reduction significantly reduces tensile strength.

In addition, during heat-sealing, the more volatile plasticizers in the vinyl sheet materials are volatilized "off" and the hinge lines tend to be more brittle than the unfused vinyl. This reduces resistance to cracking failure. Moreover, during the heat-sealing operation, the vinyl films along the hinge lines are invariably stretched over the edges of the chipboard inserts when drawn together for sealing so that the plastic sheet material in these areas becomes thinner (thickness reduction to 33% to 50% are typical) than the unsealed vinyl and thus more susceptible to material fatigue failure.

Still another practical problem caused by the shortcomings of the abovedescribed prior art construction might be called spine intrusion. This problem occurs when the binder, filled with pages, is sitting in, a vertical position (with the spine vertical) for a long period of time. More specifically, the loose leaf mechanism of the binder is riveted to the spine and loaded with paper. The binder is then placed on a shelf in a vertical position, as normally seen in a book case. The weight of the paper on the top ring rotates the spine inward or forward until the bottom front corner of the edges of the paper comes to rest on the storage shelf. This stress on the spine and hinges causes the spine-edge of the covers to spread outward and the upper part of the spine to move inward between the covers. This happens over a period of time, which varies depending upon the weakness of the hinge, and the weight of the paper. The end result is that usually the upper one third of the spine is bent inward and the outside of the top of the spine is either flush with, or inside the upper edges of the front and back covers of the loose leaf binder. This effect detracts from the appearance of the binder. More importantly, this pulling stress on the hinges frequently causes the hinges to tear, thus damaging the binder. These and other difficulties experienced with the prior art devices have been obviated in a novel manner by the present invention.

The principal object of this invention is to provide an improved ring binder construction and method of fabricating the same which overcome the drawbacks of the prior art construction.

Another object of this invention is to provide an improved ring binder cover having a spine and hinge construction of remarkably enhanced durability without sacrifice in either the appearance or functionality of the binder.

A still further object of this invention is the provision of a plastic-sealed binder which has the appearance of the more expensive case-bound-type binder.

With these and other objects in view, as will be apparent to those skilled in the art, the invention resides in the combination of parts set forth in the specification and covered by the claims appended hereto.

BRIEF DESCRIPTIONS OF THE DRAWINGS

The above and other objects and advantages of this invention will be more readily apparent from a reading of the following description taken in conjunction with the following drawings in which.

DESCRIPTION OF THE PREFERRED EMBODIMENT

Figure 1:
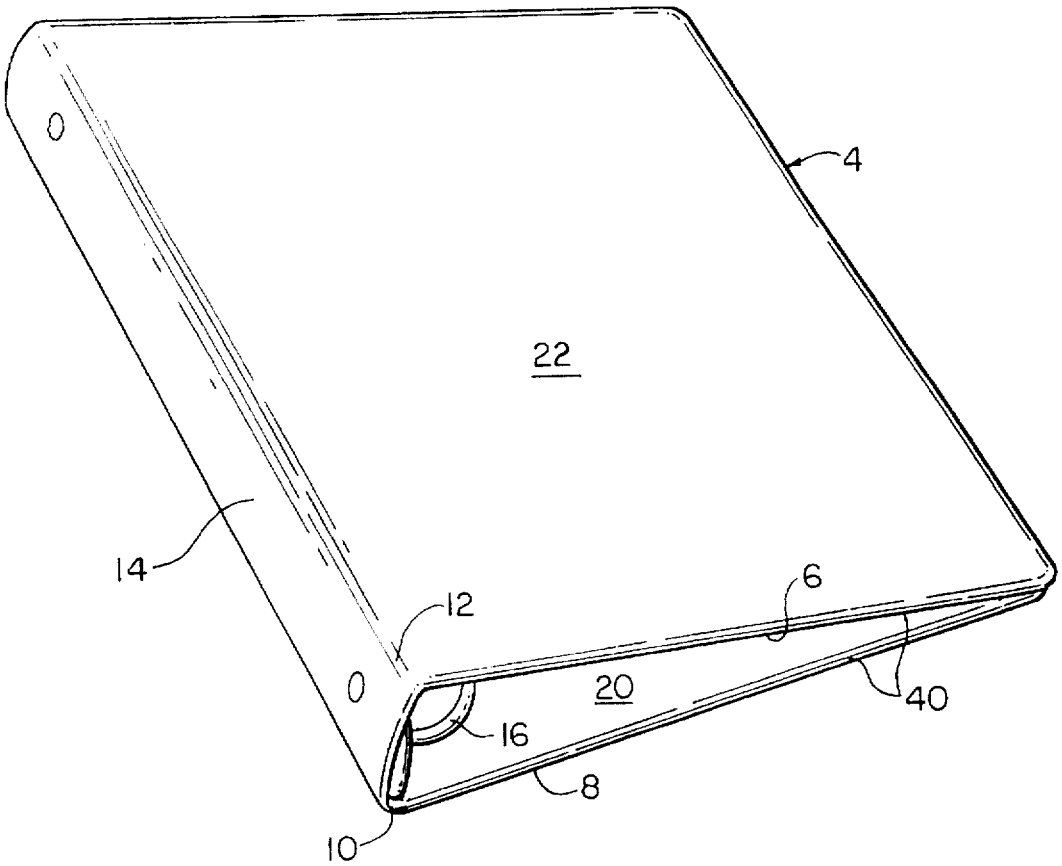
FIG. 1 is a perspective view of a ring binder of the type embodying this invention.

Referring in detail to the drawings, FIG. 1 shows a ring binder 4 of the type embodying this invention. The ring binder includes front and back cover panels 6 and 8, respectively. The two cover panels are hinged along transverse hinge lines 10 and 12 to a back panel or the spine portion of the binder, as indicated generally 14. A conventional ring binder mechanism 16 is affixed to the inner surface of the binder along its backbone portion.

The binder is composed of two rectangular sheets or films 20 and 22 of a synthetic plastic material which is preferably a thermoplastic heat-sealable or fusible material, such as an ethyl-vinyl-acetate polymer, a poly-vinyl-chloride polymer, or a polyolefin. The polymer sheets 20 and 22 are of sufficient overall size to form the entire inner and outer surface covering of the binder. These sheets may be of any desirable surface texture and may be of any suitable color to give the binder its desired appearance.

Figure 2:
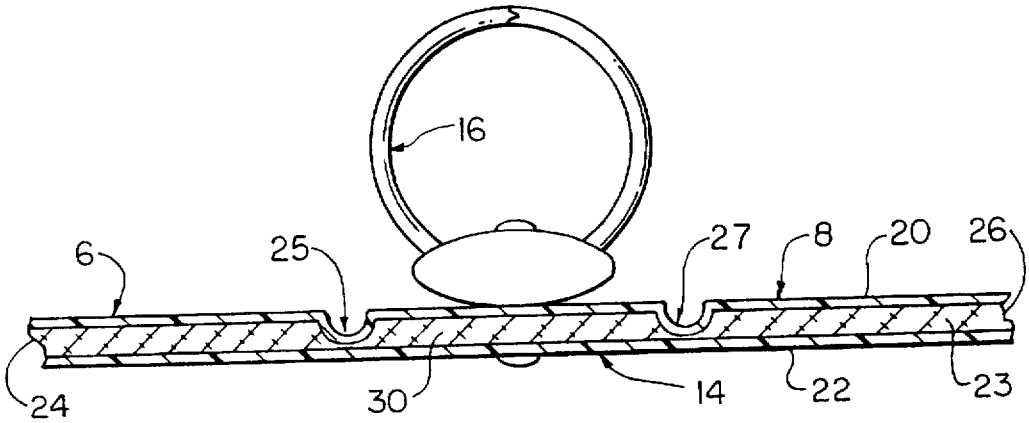
FIG. 2 is a sectional elevational view on an enlarged scale showing a portion of the binder of FIG. 1.
Figure 3:
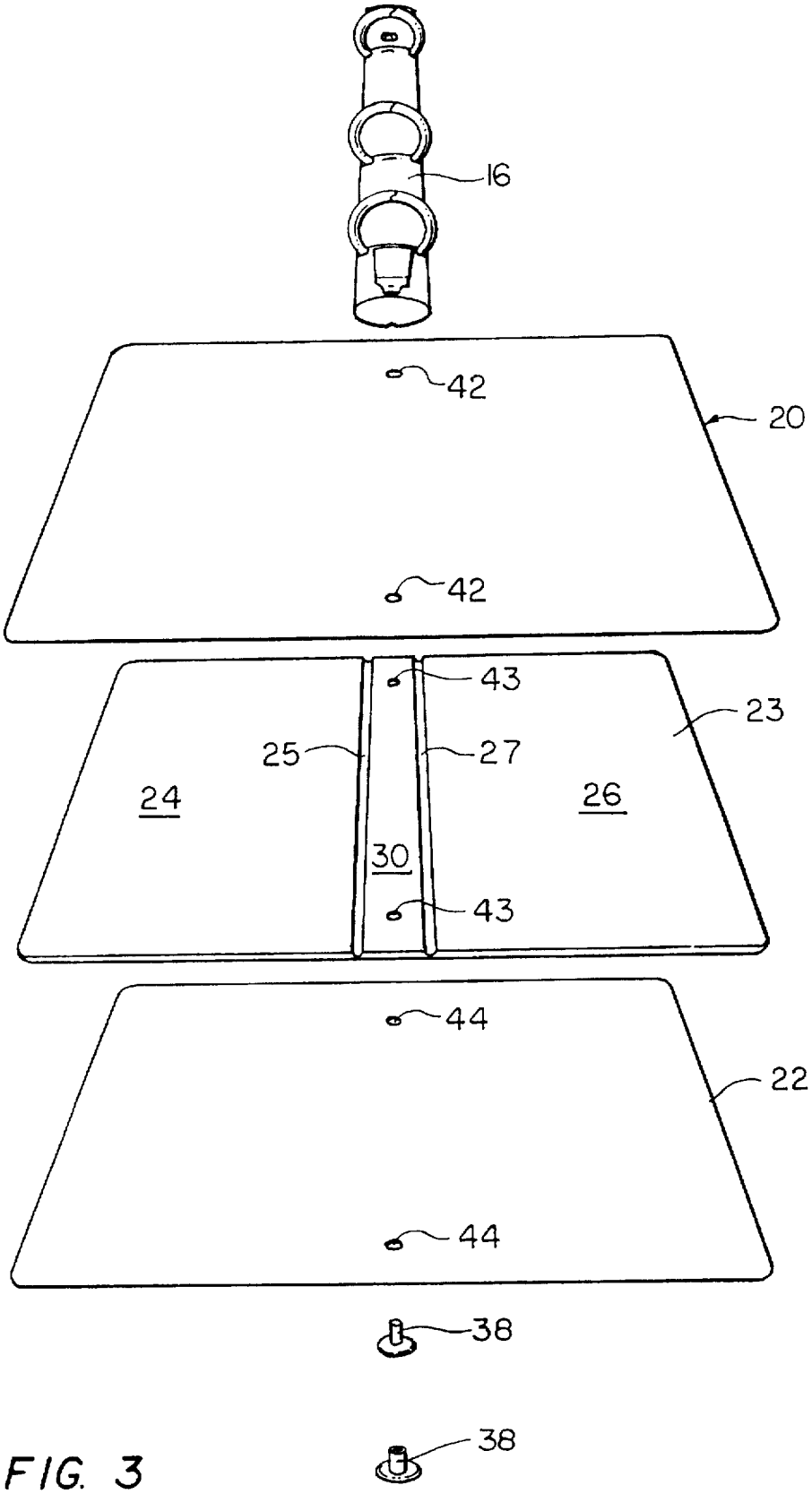
FIG. 3 is an exploded perspective view showing the components of which the ring binder embodying this invention is composed.

Referring to FIGS. 2 and 3, disposed between thermoplastic sheets, is a semirigid or form stable, rectangular insert 23. The insert 23 is formed or machined with two parallel grooves 25 and 27 which divide the insert into three zones. Zones 24 and 26 are dimensioned to be approximately the same length and width as the cover panels of the binder. Zone 30 is dimensioned to be approximately the same length and width as the spine 14. The insert may be made of any suitable stiffening material, such as clipboard or fiberboard. The stiffening material and, the depth of the grooves 25 and 27 are selected so that the grooves form stable but flexible hinges.

In fabricating the binder, the cover insert 23, made up of zones inserts 24, 30, and 26 are disposed between the two sheets of the vinyl polymer sheet material 20 and 22 and only the peripheral edges 40 (FIG. 1) of the vinyl sheets are sealed together. In this manner, a large sealed pocket or envelope is formed which encapsulates the insert. It will be noted that no transverse sealing of the vinyl sheets, to each other is carried out in the area of the binder backbone at or between the hinges 25 and 27 of the cover insert 23. Thus, as best illustrated in FIG. 2, the thermoplastic sheets or films remain entirely separated from each other (except, of course, at the ends of each hinge) and unfused to each other (except at the hinge ends) in the hinge areas of the binder cover.

Because the space between the sheets 20 and 22 is evacuated, the sheet 20 is drawn into the grooves 25 and 27 so to form an attractive hinge inner surfaces. Adhesive between the insert 23 and the sheets 20 and 22 bonds the sheets 20 and 22 to the insert 23 and especially to the webs 32 and 34, to keep the fabricated structure stable and to cause the insert 23 and sheets 20 and 22 to cooperate in making the hinges very strong.

The spine zone 30 includes a pair of upstanding posts, studs or rivets 38 which are longitudinally spaced apart to fit through correspondingly spaced holes 42, 43 and 44 provided through the vinyl sheets and insert, along the centerline thereof. By peening over their inner ends, the rivets serve to fasten the base plate of the binder mechanism 16 securely against the inner surface of the sheet 20.

The hinges 10 and 12 of the binder are formed by the strong material remaining at the bottom of each groove 25 and 27. With this construction, there is no thermal sealing or fusion of the thermoplastic sheet material in the hinge areas. The sheets will thus retain their inherent tear strength and pliability and remain highly resistant to embrittlement and material fatigue in contrast to such tendencies in similar types of binders which heat seal in the hinge area.

This construction thus has all the advantages of the conventional three-ply binder construction with stiffening inserts sealed between thermoplastic sheets, but does not suffer the drawbacks of these prior binder constructions because the hinges are formed of the unitary insert material.

Figure 4:
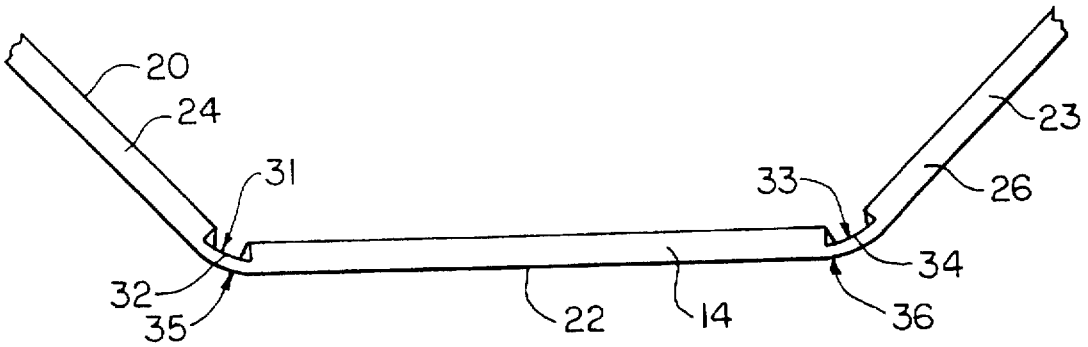
FIG. 4 is diagrammatic elevation view of the hinge action embodied in the present invention.
Figure 5:
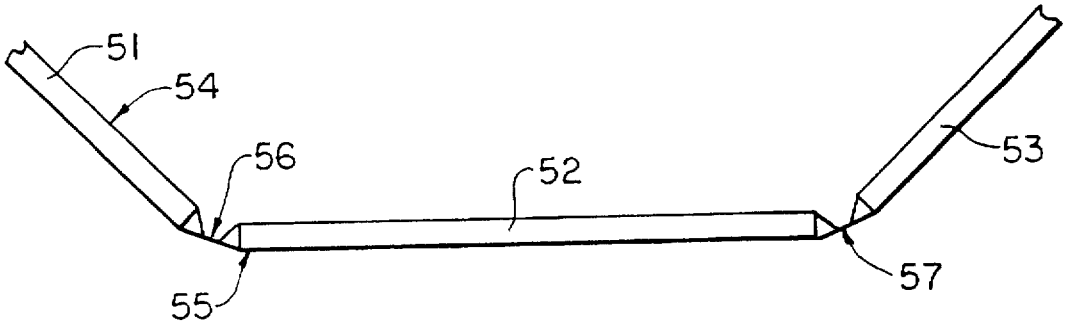
FIG. 5 PRIOR ART
FIG. 5 is a diagrammatic elevation view of a prior art plastic hinge action.
Figure 6:
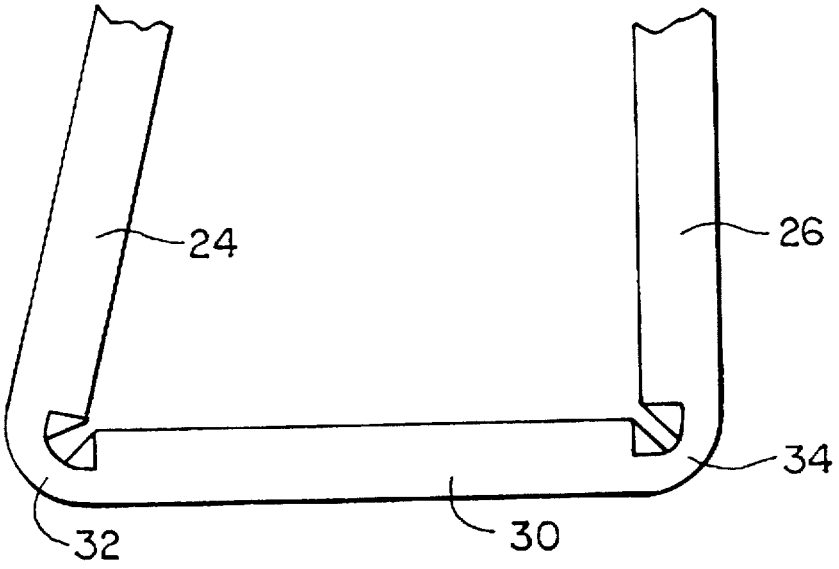
FIG. 6 is a diagrammatical elevational view illustrating how the stability of the hinge embodied in the present invention prevents spreading of the front and back covers and thereby prevents the binder contents from pulling the spine inward.
Figure 7:
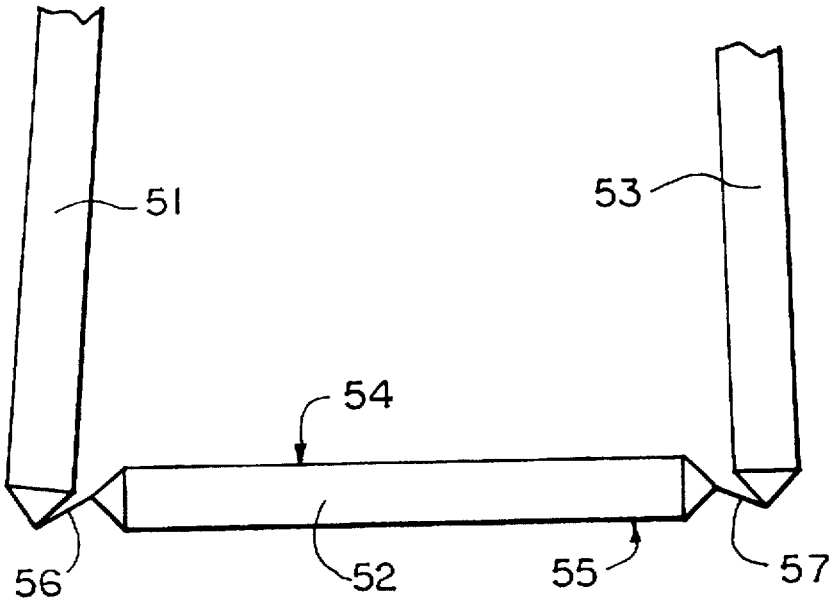
FIG. 7 PRIOR ART
FIG. 7 is a diagrammatical elevational view of a prior art hinge structure, which allows the covers to spread and the spine to be drawn inward.

The manner which the hinges of the present invention function to eliminate spine intrusion is best shown in FIGS. 4 and 6. FIG. 4 shows the binder starting to close. Each flexible web 32 and 34 is shown adhesively bound to adjacent portions 31 and 33 of the inner sheet 20, and adjacent portions 35 and 36 in the outer sheet 22. The adjacent portions are not thermally treated and therefore retain their full thickness, strength and failure resistance. FIG. 6 shows that the stability of the hinge prevents spreading of the front and back cover and thereby prevents the binder contents from pulling the spine inward. FIGS. 5 and 7 show the prior art hinge structure, which, as shown in FIG. 7, allows the covers to spread and the spine to be drawn inward. The Separate insert pieces 51, 52 and 53 are eachsurrounded by the inner sheet 54 and outer sheet 55. The sheets are heat-sealed between the zones to form hinges 56 and 57.

Figure 8:
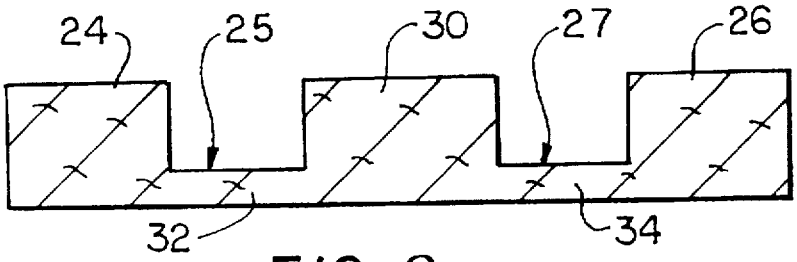
FIG. 8 is a diagrammatical section view of a first embodiment of an insert constructed according to the teachings of the present invention, the insert comprising a sheet of fiber board milled with two grooves, rectangular in cross-section.
Figure 9:
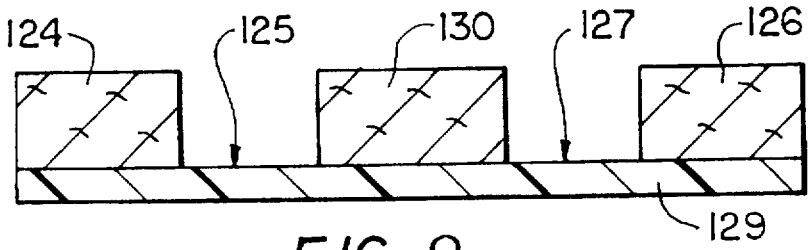
FIG. 9 is a diagrammatical section view of a second embodiment of an insert constructed according to the teachings of the present invention, the insert comprising three separate boards glued to a flexible backing.
Figure 10:
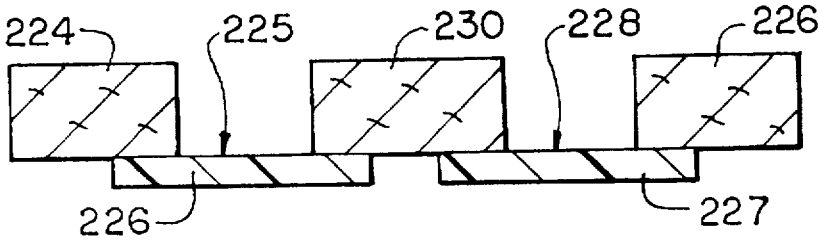
FIG. 10 is a diagrammatical section view of a third embodiment of an insert constructed according to the teachings of the present invention, the insert comprising three separate plates interconnected by a pair of flexible tapes.

The unitary hinged insert of the present invention may be formed in many ways. In each case, the hinges are formed by flexible webs which connect the three insert zones together. FIG. 8 shows a diagrammatic sectional view of the preferred method in which a sheet of fiber board is milled with two grooves, preferably rectangular in cross-section. The webs 32 and 34 which remain after the milling act as strong hinges. In FIG. 9, a variation is shown in which three separate boards 124, 130 and 126 are glued to a flexible backing 129 to form webs 125 and 127. FIG. 10 shows a variation in which webs 225 and 228 are formed between three separate plates 224, 230, and 226 using flexible tapes 226 and 227.

Figure 11:
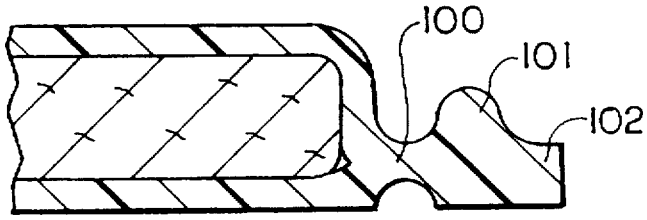
FIG. 11 PRIOR ART
FIG. 11 is a diagrammatical section view of the peripheral seal of a conventional ring binder.
Figure 12:
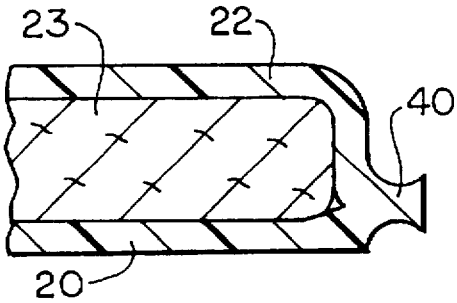
FIG. 12 is a diagrammatical section view of the minimal seal of a ring binder constructed according to the teachings of the present invention.

The binders which are formed by employing the principles of the present invention have a hinge construction which give the exterior of the spine of the binder the look of a more expensive, case-bound product. This look of quality can be enhanced by sealing the peripheral edges 40 with a geometry which carries the case-bound look to the entire exterior of the binder. More specifically, as shown in cross-section in FIG. 11, the conventional peripheral seal has a cross-section which includes an inner sealed construction 100, a bead 101 exterior to the inner constriction, and then an outer seam 102. By eliminating the bead and outer seam, and thereby leaving only a single minimal seal, as shown in cross-section in FIG. 12, a case-bound look can be achieved.

It is obvious that minor changes may be made in the form and construction of the invention without departing from the material spirit thereof. It is not, however, desired to confine the invention to the exact form herein shown and described, but it is desired to include all such as properly come within the scope claimed.

Having thus disclosed this invention, what is claimed is:

1. A ring binder comprising:

(a) an insert, said insert having a pair of parallel flexible webs spaced apart a predetermined distance to divide said insert into three rigid zones, hingedly connected by said pair of parallel flexible webs, said zones being dimensioned to define a front cover panel, a back cover panel and a spine panel, (b) a matching pair of thermoplastic heat-sealable sheets disposed on opposite sides of said insert and heat-sealed together only about their peripheral edges, and (c) a ring mechanism fixed to said spine panel.

2. The ring binder as set forth in claim 1, wherein said insert comprises a sheet of fiber board milled with two grooves.

3. The ring binder as set forth in claim 1, wherein said insert comprises three separate boards attached to a flexible backing.

4. The ring binder as set forth in claim 1, wherein said insert comprises a center plate and a pair of end plates, the center plate and one of the end plates being interconnected by a first flexible tape and the center plate and the other of the end plates being interconnected by a second flexible tape.

5. The ring binder as set forth in claim 1, wherein one of said matching pair of thermoplastic heat-sealable sheets is adhesively bonded to the insert.

6. The ring binder as set forth in claim 1, wherein both of said matching pair of thermoplastic, heat-sealable sheets are adhesively bonded to the insert.

7. The ring binder as set forth in claim 1, wherein the peripheral edges of said matching pair of thermoplastic, heat-sealable sheets are sealed with a single minimal seam.

* * * * *